US005448155A

United States Patent [19]

Jutras

[11] Patent Number: 5,448,155

[45] Date of Patent: Sep. 5, 1995

[54] REGULATED POWER SUPPLY USING MULTIPLE LOAD SENSING

[75] Inventor: Mark A. Jutras, Upton, Mass.

[73] Assignee: International Power Devices, Inc., Brighton, Mass.

[21] Appl. No.: 345,535

[22] Filed: Nov. 28, 1994

Related U.S. Application Data

[63] Continuation of Ser. No. 965,333, Oct. 23, 1992, abandoned.

[51] Int. Cl.[6] ..... G05F 1/565

[52] U.S. Cl. ..... 323/285; 323/266; 363/79

[58] Field of Search ..... 323/234, 246, 265, 266, 323/273, 274, 275, 285, 282; 363/97, 98, 78, 79

[56] References Cited

U.S. PATENT DOCUMENTS

| | | | |
|---|---|---|---|
| 3,805,142 | 4/1974 | Rando | 321/11 |
| 3,818,307 | 6/1974 | Hamilton et al. | 321/11 |
| 4,114,048 | 9/1978 | Hull et al. | 307/53 |
| 4,230,981 | 10/1980 | Rambold | 323/25 |
| 4,245,294 | 1/1981 | Brolin | 363/126 |
| 4,484,256 | 11/1984 | Hartman | 363/26 |
| 4,752,864 | 6/1988 | Clappier | 363/86 |
| 4,858,094 | 8/1989 | Barlage | 363/21 |
| 4,983,955 | 1/1991 | Ham, Jr. et al. | 340/664 |
| 5,003,192 | 3/1991 | Beigel | 307/140 |
| 5,068,604 | 11/1991 | Van de Lagemaat | 324/158 R |
| 5,103,109 | 4/1992 | Khazam et al. | 307/53 |
| 5,161,098 | 11/1992 | Balakkishnan | 363/144 |
| 5,221,887 | 6/1993 | Gulczynski | 323/285 |
| 5,264,781 | 11/1993 | Miller et al. | 323/282 |

*Primary Examiner*—Steven L. Stephan
*Assistant Examiner*—Adolf Berhane
*Attorney, Agent, or Firm*—Fish & Richardson

[57] ABSTRACT

A regulated power source for supplying power to a circuit, the power source including a regulated power converter generating an output voltage for the circuit, the converter including a control terminal through which the output voltage can be regulated by feedback from the circuit; a monitoring circuit including a plurality of input terminals each of which monitors a voltage at a different location on the circuit, the monitoring circuit producing a control signal that is a function of all of the monitored voltages at the plurality of input terminals, the control signal driving the control terminal of the regulated power converter so as to regulate the output voltage to maintain the control signal at a constant value.

18 Claims, 2 Drawing Sheets

REGULATED POWER SUPPLY USING MULTIPLE LOAD SENSING

This is a continuation of application Ser. No. 07/965,333, filed Oct. 23, 1992, now abandoned.

BACKGROUND OF THE INVENTION

An electronic power supply takes as input a voltage source that can vary in magnitude and is therefore called unregulated. The output of an electronic power supply is usually a voltage source that is fixed in magnitude and is therefore called regulated. A DC to DC converter is an electronic power supply which takes as an input an unregulated DC voltage and provides as output a regulated DC voltage. Current is drawn from the output of an electronic power supply by the attached load. If the attached load is located far from the output terminals of a power supply then a voltage drop will occur in the distribution path resulting in a lower voltage at the load than at the power supply's output terminals. This voltage drop is a result of the load current flowing through the distribution impedance. The result of the distribution voltage drop is poor regulation at the load point. This can cause problems in some systems.

Normally an electronic power supply senses the voltage at its output terminals and regulates the voltage at this point. For systems where distribution voltage drops are a problem, a single pair of sense pins may be provided. The sense pins monitor the voltage at the load point and then the power supply adjusts its output so that the voltage directly across the load is regulated. This single point sensing is commonly used by many power supply manufacturers.

Single point sensing works very well when a single load element is placed across a power supply's output. If a power supply is to provide a single output for multiple loads than each of these loads has to be connected across a single point if single point load sensing is to work correctly. In some applications the single point connection of many loads is easy to achieve. However, in many places a compromise solution has to be implemented. One compromise is to connect the single pair of sense pins at the "electrical center" of a distribution system and thus regulate that point.

SUMMARY OF THE INVENTION

Single point sensing for multiple loads is usually a problem in systems that have a power plane such as large printed circuit boards and system back panels. The need for accurate load sensing is becoming more evident because new IC technologies and modern back panel termination schemes require very low DC voltages. These new DC voltages are usually under 5 V (e.g. 3.3 V, 2.5 V, and 1.4 V are common). In low voltage systems even small voltage drops can cause problems. Moreover, the applications which use low voltage usually have high DC currents resulting in larger distribution voltage drops.

The applicant has invented a method of providing multiple load sensing. The multiple load sensing circuit can have from O to N pairs of sense terminals. An electronic power supply that has multiple sensing will adjust its output voltage to the average of all the sense points.

In general, in one aspect, the invention is a regulated power source for supplying power to a circuit. The power source includes a regulated power converter generating an output voltage for the circuit, the converter including a control terminal through which the output voltage can be regulated by feedback from the circuit; a monitoring circuit including a plurality of input terminals each of which monitors a voltage at a different location on the circuit, the monitoring circuit producing a control signal that is a function of all of the monitored voltages at the plurality of input terminals, the control signal driving the control terminal of the regulated power converter so as to regulate the output voltage to maintain the control signal at a constant value.

Preferred embodiments include the following features. The control signal is function of the monitored voltages and has the following form:

$$\text{CONTROL SIGNAL} = \frac{1}{N}\sum_{i=1}^{N} K_i V_i,$$

where N is the number of the plurality of sensing circuits, $K_i$ is a positive number and $V_i$ is the monitored voltage at the input terminal of the $i^{th}$ sensing circuit. In one preferred embodiment, the $K_i$'s are all equal. The monitoring circuit includes a plurality of sensing circuits each of which receives the sensed voltage from a different one of the plurality of input terminals and generates an output signal that is proportional to the sensed voltage at the input terminal for that sensing circuit; and it includes an averaging circuit generating the control signal that is equal to:

$$\text{CONTROL SIGNAL} = \frac{1}{N}\sum_{i=1}^{N} K_i V_{si},$$

where N is the number of said plurality of sensing circuits, and $V_{si}$ is the sensed voltage at the input terminal of the $i^{th}$ sensing circuit. Each of the sensing circuits includes a differential amplifier employing negative feedback. Also, the power supply is a DC-to-DC converter.

In general, in another aspect, the invention is a method for regulating an output voltage supplied by a power supply to a circuit. The method includes sensing a voltage at each of a plurality of different locations in the circuit; generating a feedback signal that is a function of all of the voltages sensed at the different locations; and using the feedback signal to regulate the output voltage of the power supply so as to maintain a constant feedback signal.

This sensing scheme is well suited for providing load sensing on back panels and large circuit boards. For example, many computer manufacturers use 15 by 15 inch logic cards in distributed power systems. In a distributed power system, a DC-to-DC converter is placed on a logic circuit board and the unregulated input voltage is distributed to each logic card. If the DC-to-DC converter for this application has 5 pairs of sense terminals than all 4 corners and the center of the board can be monitored and the DC-to-DC converter would regulate the average voltage on the entire circuit board.

DESCRIPTION OF THE PREFERRED EMBODIMENT(S)

Figure 1:
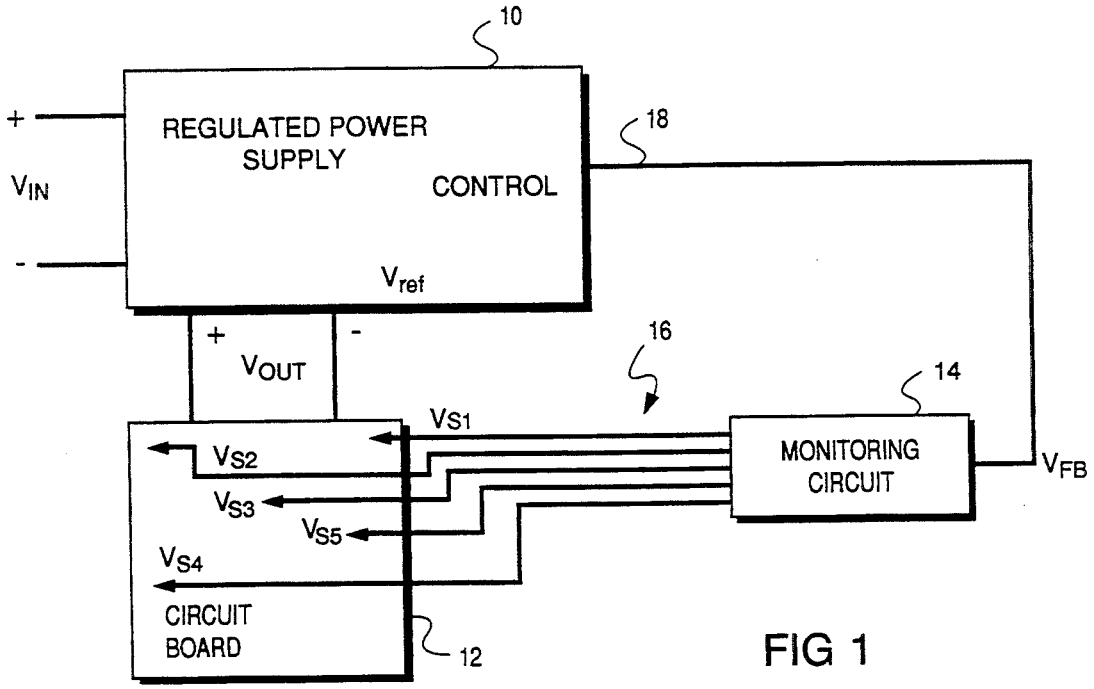
FIG. 1 is a block diagram of a regulated power supply that incorporates the invention.

Referring to FIG. 1, a system which incorporates multiple load sensing to regulate the output of a power source includes a regulated power supply 10, a circuit board 14 and a monitoring circuit 14 with multiple voltage sensing probes 16 for sensing voltage at multiple locations on circuit board 12. Power supply 10 converts an input voltage $V_{in}$ to a regulated output voltage $V_{out}$ that powers the circuitry on circuit board 12. The supply voltage is distributed throughout circuit board 12 via wires or conduction paths to the different components and subcircuits which are present on circuit board 12. Due to voltage drops that exist both in the lines supplying the voltage to board 12 and in wires or conduction paths on board 12, it is likely that the supply voltage will vary throughout the board and will be less than the supplied voltage of $V_{out}$. It is desirable, however, that the voltage throughout the circuit board remain within a very narrow range as dictated by the requirements of the devices and components used on the board. Using the multiple sensing probes 16, monitoring circuit 14 monitors the supply voltage at different locations on board 12 and generates a voltage $V_{FB}$ that is equal to the average of the monitored voltages. $V_{FB}$ is fed back to a control terminal 18 of power supply 10 to regulate the output voltage of power supply 10. When $V_{FB}$ decreases due to higher loads within circuit 14, power supply 10 responds by increasing $V_{out}$ to keep $V_{FB}$ close to an internal reference voltage $V_{ref}$. Conversely, when $V_{FB}$ increases, power supply 10 decreases $V_{out}$ to keep $V_{FB}$ close to the internal reference voltage $V_{ref}$.

Figure 2:
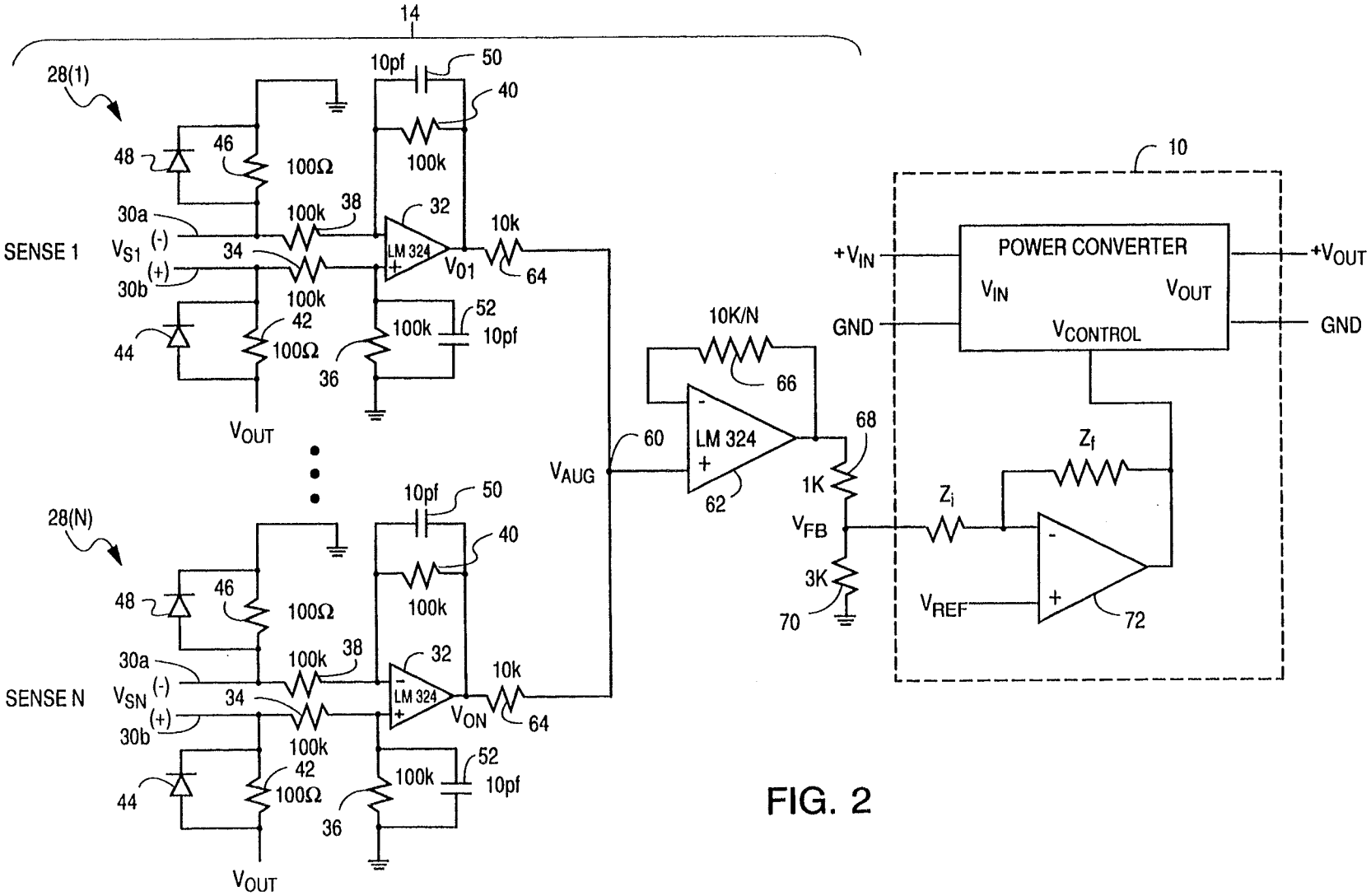
FIG. 2 is a circuit diagram showing details of an implementation of the monitoring circuit of FIG. 1.

An implementation of monitoring circuit 14 is shown in FIG. 2. It includes N identical input circuits 28(1)–28(N), each one associated with a different set of input lines **30(*a*) and 30(*b*), representing the sensing probes that monitor the voltages at different locations on circuit 14. The sensed voltages are labelled $V_{si}$, where $1 \leq i \leq N$. Each sensed voltage $V_{si}$ drives the input of a differential amplifier 32** configured as a noninverting amplifier. Since the input circuits are identical, only the first one is described in detail.

The positive sense signal $V_{s1}(+)$ on the input line **30*b* drives the positive input of amplifier 32 through a voltage divider to ground. The voltage divider is made up of a pair of resistors 34 and 36. The negative sense signal $V_{s1}(-)$ drives the negative input of amplifier 32 through a resistor 38 and the negative input of amplifier 32 is, in turn, connected to the output of amplifier 32 through a feedback resistor 40**.

The output of the amplifier in each input circuit 28(1)–28(N) drives a common node 60 at the positive input of an operational amplifier 62 through a resistor 64. Amplifier 62 is configured as a follower with a feedback resistor 66. Its output voltage is dropped across a voltage divider formed by resistors 68 and 70 to produce a feedback voltage $V_{FB}$. The feedback voltage $V_{FB}$ provides the control voltage that regulates power supply 10.

Typically, the feedback signal $V_{FB}$ is fed to the input of an error amplifier 72 in regulated power supply 10. The error amplifier 72 compares the average feedback signal to a reference $V_{ref}$ and generates a control signal that adjusts the power supply's output.

Each pair of differential amplifier inputs may or may not be connected directly to the power supply's output terminals through small resistors and clamping diodes. In the described embodiment, positive input line **30*b* is connected to the positive supply voltage through the parallel combination of a pull-up resistor 42 and a clamp diode 44. Negative input line 30*a* is connected to ground through a pull-down resistor 46 and another clamp diode 48. If these additional pull-up and pull-down resistors 42 and 46 are included, any set of sense inputs that is left floating will assume approximately the voltage directly at the power supply's output. In addition, they prevent the power supply from running "open loop" in the event that all sense lines are left "floating". Diodes 44 and 48 "clamp" the sense range to two diode drops for the amplifier. Also optional are capacitors 50 and 52 which may be inserted in parallel with resistors 40 and 36**, respectively, to provide filtering.

In the described embodiment, the input circuits are configured to yield unity gain and to have a relatively high input impedance so as to avoid unnecessarily loading the point being monitored on the circuit board. Thus, resistors 34, 36, 38 and 40 are 100 KΩ and the pull-up and pull-down resistors are 100 ohms. The value of resistor 66 is selected to balance the offset current generated by the amplifiers in the input circuits. Its value is 10/N KΩ.

It should be apparent that the voltage at the output of each input circuit $V_{oi}$ is equal to $V_{si}=V_{si}(+)-V_{si}(-)$, where $V_{si}(+)$ and $V_{si}(-)$ are the voltages on the positive and negative input lines **30*b* and 30*a*, respectively. Since the sum of the currents into the positive input terminal of differential amplifier 62** is zero, it can also be readily seen that the voltage at that input $V_{avg}$ is:

$$V_{avg} = \frac{1}{N} \sum_{i=1}^{N} V_{si}.$$

That is, $V_{avg}$ is simply the average of the N sensed voltages from the monitored circuit.

If the reference voltage $V_{ref}$ in the controller to the power supply is 2.5 volts and the desired output voltage from the supply is 3.3 volts, this can be accomplished by using resistors 68 and 70 having values of 1K and 3K, respectively.

$$2.5 = 3.3 \frac{3K}{1K + 3K}.$$

Although monitoring circuit 14 in the above-described embodiment generates a simple average of the sensed voltages, through simple modifications it can easily generate a weighted average. For example, this could be accomplished by having a different resistance value for resistor 64 that is in series with the outputs of one or more of differential amplifiers 32. Another method of weighting the average would be to use a different gain for one or more of input circuits. Instead of setting the values of resistors 34, 36, 38, and 40 all equal, they can be selected appropriately achieve the desired non-unity gain. Thus, it would be straight forward to implement a weighted average of the form:

$$V_{avg} = \frac{1}{N} \sum_{i=1}^{N} K_i V_{si},$$

where the weights $K_i$ are not all equal.

Other embodiments are within the following claims. For example, the invention encompasses any electronic power supply that incorporates the multisensing feedback feature. Any power supply includes but is not limited to, a linear power supply, an offline power supply, a modular power supply, or DC-to-DC converter that provides feedback sensing. Furthermore, the power converter can be any single or multiple output, linear, switching, or resonant converter, isolated or non-isolated, including, but not limited to, the following: Buck, Boost, Buck Boost, Flyback, CUK, Buck Derived topologies, Push Pull, Full Bridge, Halve Bridge, Forward, Resonant, Classical Resonant, Quasi-Resonant, Zero Voltage Switching (ZVS), Zero Current Switching (ZCS), Below Resonance, Above Resonance, At Resonance, Overlapping Conduction, Series Pass Element, Current Shunt Element.

The control signal that is fed back to the power supply can be a average of all the sense points, an average that is weighted in favor of one or more of the sense points, or any function of the voltages at the sense points. The control signal can be any voltage or current signal that is used to control the output of a power converter. The control signal can adjust the power converter's output using any one, or combination, of the known methods including, Pulse Width Modulation (PWM), Frequency Modulation (FM), Amplitude Modulation (AM), and Phase Modulation.

What is claimed is:

1. A regulated power source for supplying power to an external circuit, said power source comprising:

a regulated power converter generating an output voltage for said external circuit, said converter including a control terminal through which the output voltage can be regulated by feedback from the external circuit;

a monitoring circuit including a plurality of input terminal pairs each of which monitors a different voltage across a different two locations in said external circuit, said monitoring circuit producing a control signal that is a function of all of the different voltages monitored by said plurality of input terminal pairs, said control signal driving the control terminal of the regulated power converter, wherein said power converter regulates the output voltage so as to maintain said control signal at a constant value.

2. The regulated power source of claim 1 wherein said control signal is function of the monitored voltages having the following form:

$$\text{CONTROL SIGNAL} = \frac{1}{N}\sum_{i=1}^{N} K_i V_i,$$

where N is the number of said plurality of input terminal pairs, $K_i$ is a positive number and $V_i$ is the monitored voltage across the ith input terminal pair.

3. The power source of claim 2 wherein the $K_i$'s are all equal.

4. The power source of claim 3 wherein the $K_i$'s are all equal to one.

5. The power source of claim 2 wherein at least some of the $K_i$'s have different values from other of the $K_i$'s.

6. The regulated power source of claim 1 wherein said monitoring circuit comprises:

a plurality of sensing circuits each of which receives the sensed voltage from a different one of said plurality of input terminal pairs and generates an output signal that is proportional to the sensed voltage at the input terminal pair for that sensing circuit; and an averaging circuit generating the control signal that is equal to:

$$\text{CONTROL SIGNAL} = \frac{1}{N}\sum_{i=1}^{N} K_i V_{si},$$

where N is the number of said plurality of sensing circuits, $K_i$ is a positive number and $V_{si}$ is the sensed voltage at the input terminal pair of the $i^{th}$ sensing circuit.

7. The power source of claim 6 wherein the $K_i$'s are all equal.

8. The power source of claim 7 wherein the $K_i$'s are all equal to one.

9. The power source of claim 6 wherein at least some of the $K_i$'s have different values from other of the $K_i$'s.

10. The power source of claim 6 wherein each of said plurality of sensing circuits comprises a differential amplifier.

11. The power source of claim 10 wherein the differential amplifier of each of said sensing circuits employs negative feedback.

12. The power source of claim 1 wherein the power supply is a DC-to-DC converter.

13. A method for regulating an output voltage supplied by a power supply to an external circuit, said method comprising:

sensing a plurality of voltage differences, each of said plurality of sensed voltage differences being sensed at different locations in said external circuit;

generating a feedback signal that is a function of all of the plurality of sensed voltage differences; and using the feedback signal to regulate the output voltage of said power supply so as to maintain a constant feedback signal.

14. The method of claim 13 wherein said feedback signal is function of the plurality of sensed voltage differences having the following form:

$$\text{CONTROL SIGNAL} = \frac{1}{N}\sum_{i=1}^{N} K_i V_i,$$

where N is the number of said plurality of sensed voltage differences, the $K_i$'s are positive numbers, and $V_i$ is the ith sensed voltage difference.

15. The method of claim 14 wherein the $K_i$'s are all equal.

16. The method of claim 15 wherein the $K_i$'s are all equal to one.

17. The method of claim 15 wherein at least some of the $K_i$'s have different values from other of the $K_i$'s.

18. A regulated power source for supplying power to an external circuit, said power source comprising:

a regulated power converter generating an output voltage for said external circuit, said converter including a control terminal through which the output voltage can be regulated by feedback from the external circuit;

a monitoring circuit including a plurality of input lines each of which monitors a different voltage at a different location on said external circuit, said plurality of input lines being greater than two, said monitoring circuit producing a control signal that is a function of all of the monitored voltages at the plurality of input lines, said control signal driving the control terminal of the regulated power converter, wherein said power converter regulates the output voltage so as to maintain said control signal at a constant value.

* * * * *